United States Patent [19]

Porchia et al.

[11] Patent Number: 5,012,561

[45] Date of Patent: May 7, 1991

[54] CLOSURE FOR RECLOSABLE THERMOPLASTIC CONTAINERS

[75] Inventors: Jose Porchia, Midland; John O. McCree, Saginaw; Brian C. Dais, Midland, all of Mich.

[73] Assignee: The Dow Chemical Company, Midland, Mich.

[21] Appl. No.: 525,937

[22] Filed: May 18, 1990

[51] Int. Cl.[5] ..... B65D 33/24

[52] U.S. Cl. ..... 24/576; 24/587; 383/63

[58] Field of Search ..... 24/576, 587, 297, 399, 24/400; 383/63, 65

[56] References Cited

U.S. PATENT DOCUMENTS

| | | | |
|---|---|---|---|
| Re. 28,969 | 9/1976 | Naito . | |
| 3,425,469 | 2/1969 | Ausnit | 24/587 |
| 4,484,352 | 11/1984 | Katzin . | |
| 4,701,358 | 10/1987 | Behr et al. | 383/63 |
| 4,731,911 | 3/1988 | Gould | 24/576 |
| 4,736,496 | 4/1988 | Fisher et al. . | |
| 4,741,789 | 5/1988 | Zieke et al. . | |
| 4,929,487 | 5/1990 | Tilman et al. | 24/576 |

FOREIGN PATENT DOCUMENTS

| | | | |
|---|---|---|---|
| 0240118 | 9/1960 | Australia | 24/297 |
| 152409 | 4/1981 | Japan . | |

OTHER PUBLICATIONS

Sketch-Exhibit A, one sheet, 1990.

*Primary Examiner*—Victor N. Sakran

[57] ABSTRACT

A closure for reclosable plastic containers including male and female closure elements having extremities which are suited for interlocking with one another, in which the interlocking extremities of the male and female elements are guided into interlocking engagement responsive to compressive force placed on the elements, as in the clamping together and edge-sealing of film portions carrying the elements.

10 Claims, 3 Drawing Sheets

CLOSURE FOR RECLOSABLE THERMOPLASTIC CONTAINERS

BACKGROUND OF THE INVENTION

The present invention relates to closures for reclosable thermoplastic containers, and more particularly to such closures of the "wide track" variety, wherein ribs are formed generally adjacent and on either side of a male or female closure element.

Reclosable thermoplastic containers bearing such male and female closure elements are presently edge-sealed by several methods. A number of well-known and commercially-employed methods of forming these containers can be described as generally involving clamping film portions together, and moving a heated element against the clamped film portions. Such a method is described, for example, in commonly-assigned U.S. Pat. No. 4,396,449 to Tumminia (the '449 patent).

In a majority of the containers made by these several methods, leaks are formed at the ends of the closures, where film portions carrying the closure elements have been edge-welded or sealed together. These leaks can impair the usefulness and appeal of these containers to consumers, as is well-known, and the frequency and magnitude of leaks are matters of considerable concern for manufacturers of such containers.

Applicants have observed that the clamping of film portions in sufficiently close relationship to form a good edge-weld or seal therebetween can compress the male and female elements together to the point where the elements are distorted.

The closure elements are very often so severely distorted as to not permit a good fit between the elements. When the film portions carrying the male an female elements are sealed together, the poor fit is made permanent adjacent the edges or sides formed by the seal and leaks ensue through the ends of the distorted closure.

A groove has been previously employed in the clamping members of apparatus for carrying out a method as described in the '449 patent, for receiving the male or female closure element therein while the film portions which are to comprise the container are clamped together and for thus relieving some of the compressive stresses on the elements.

Despite the provision of such grooves, however, the male and female closure elements of reclosable thermoplastic containers made by this and like methods frequently still are compressed together and distorted to such an extent that leaks occur at the ends of the closures.

SUMMARY OF THE PRESENT INVENTION

The present invention overcomes this continuing difficulty by providing a closure for reclosable plastic containers which is self-sealing in response to deforming compressive force acting on the closure. The closure is "self-sealing" in that the male and female closure elements which comprise the closure are guided, by virtue of the shape and structure of the closure itself, toward rather than away from an interlocking engagement and a proper alignment in response to the above-mentioned force.

The closure of the present invention thus broadly comprises oppositely disposed closure elements having interlocking extremities, and means for guiding each of the extremities of a closure element which are suited for interlocking with an extremity of the oppositely disposed closure element toward such an interlocking engagement when deforming compressive force is applied to the closure elements.

Reclosable plastic containers bearing such a closure, as well as methods for making these containers, are also described.

DETAILED DESCRIPTION OF THE PREFERRED EMBODIMENTS

The present invention may be more fully understood with reference to FIGS. 1 through 5, as briefly described above.

Figure 1:
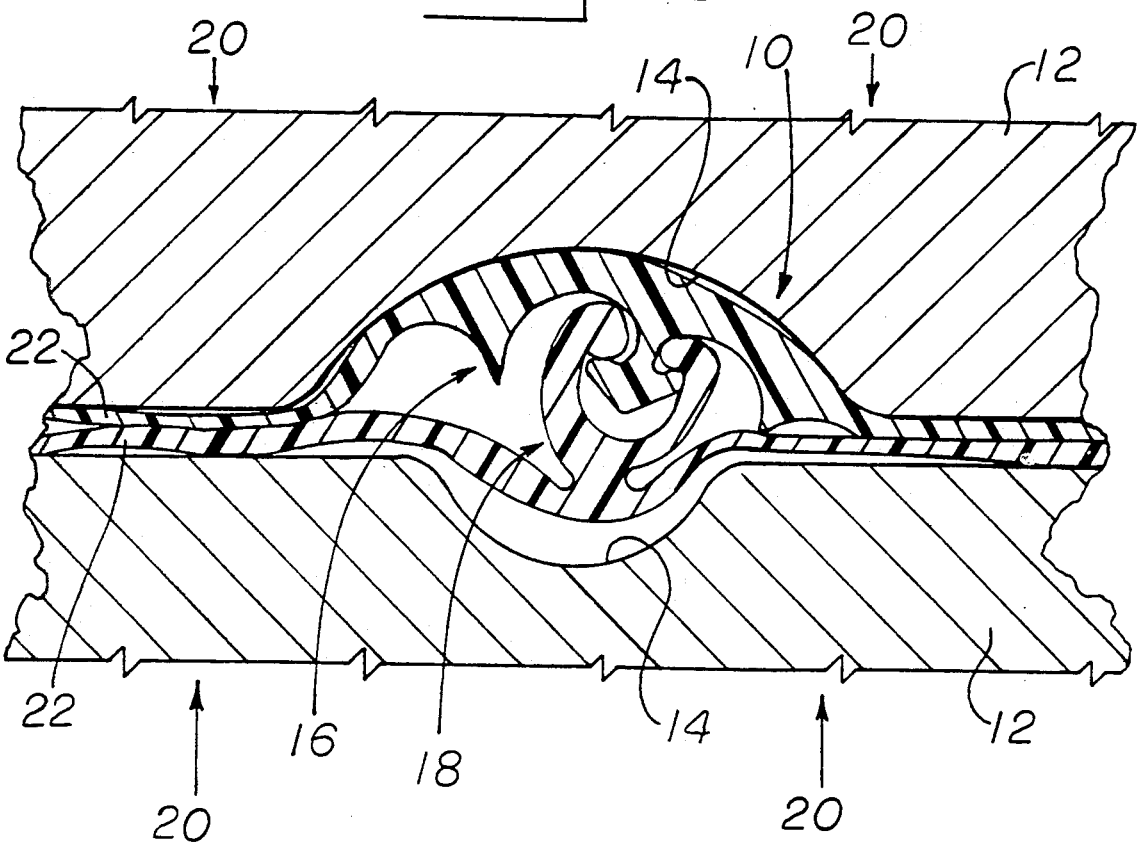
FIG. 1 depicts the distortion in a representative edge-sealing apparatus, under deforming compressive force, of a closure of the type described in common U.S. Pat. No. 4,736,496 to Fisher et.al.

FIG. 1 illustrates the distortion of a closure 10 of the "wide track" variety and described more particularly in commonly-assigned U.S. Pat. No. 4,736,496 to Fisher et.al., which patent is hereby incorporated herein by reference, in a typical thermoplastic bag sealer with clamping bars 12.

Despite the provision in bars 12 of grooves 14 for accommodating the male and female closure elements 16 and 18, respectively, of the closure 10, it can be seen that some distortion of the closure 10 still occurs in the presence of the deforming compressive forces (represented by the arrows 20) involved in clamping together the film portions 22 to be joined. A "deforming compressive force", it should be noted, is intended only to suggest a force acting on the elements of a closure which is of a sufficient magnitude to cause distortion and a poor fit between the elements. This distortion of the male and female elements 16 and 18, which is made permanent in the containers on sealing the film portions 22 together, can as noted earlier be severe enough to cause the containers formed from the film portions 22 to leak or be prone to leaking.

Figure 2:
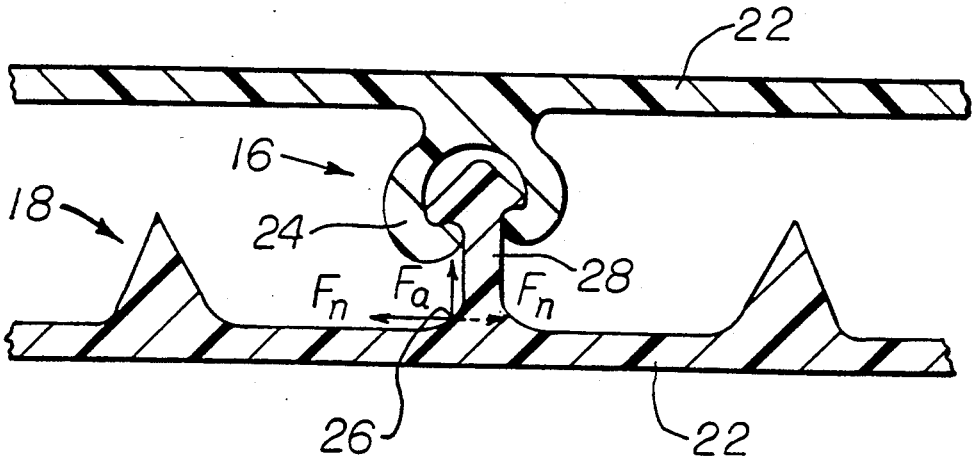
FIG. 2 is an enlarged cross-sectional view of a closure of the type described in commonly-assigned U.S. Pat. No. 4,736,496 to Fisher et.al., showing the male and female closure elements of the closure in interlocking engagement.

Referring now to FIG. 2, in a conventional closure 10, a female profile member 24 is in the clamping together of film portions 22 brought into contact with the base 26 of a male profile member 28. At the point of contact between the member 24 and the base 26, the force exerted by the base 26 on the member 24 can be resolved into a component $F_a$ which acts along the axis of the male profile member 28 and into a component $F_n$ acting in a direction which is normal to the axis of the male profile member 28. The component force $F_n$, as will be appreciated, tends toward the separation of the male profile member 28 and the female profile member 24 and thus toward the formation of leaks through the closure 10.

The closure of the present invention, in contrast, is designed so that such a force $F_n$ is not exerted on the member 24 by the member 28, but rather so that a force $F_n'$ is created which acts on the member 24 and which tends to push the female and male profile members 24 and 28 together.

Figure 3:
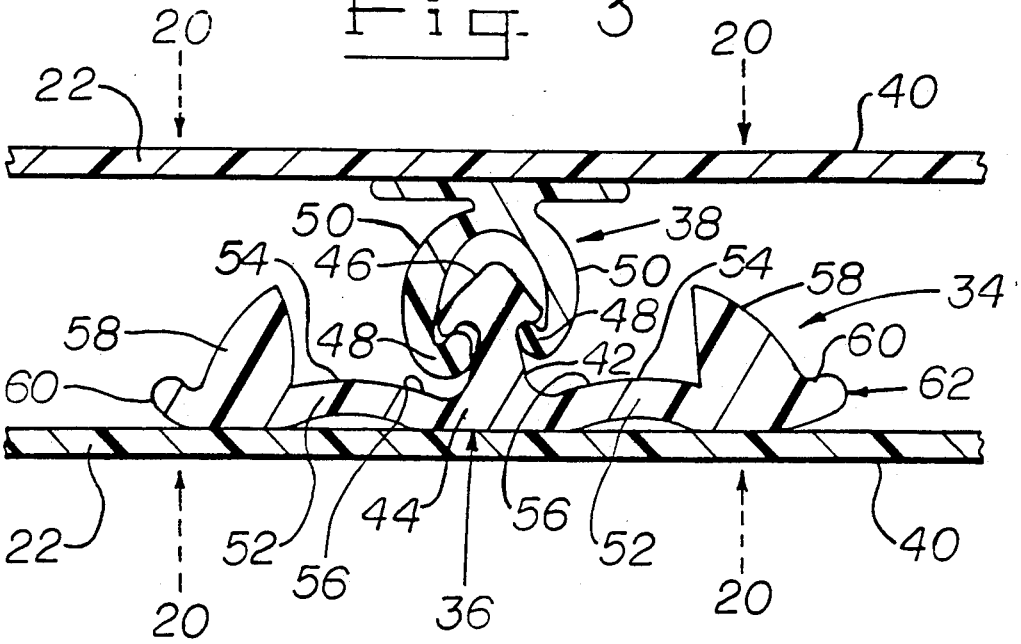
FIG. 3 is an enlarged cross-sectional view of one version of the closure of the present invention, again showing the male and female closure elements in interlocking.

One embodiment of the closure of the present invention is depicted in FIG. 3 and generally designated by the numeral 34. The closure 34 comprises oppositely disposed male and female closure elements 36 and 38, and means for guiding the elements 36 and 38 into interlocking engagement when deforming compressive force is applied as by clamping bars 12 to the male and female closure elements 36 and 38. This force, applied to the outer surface 40 of a film portion 22 relative to a closure element 36 or 38 carried thereon and to the interior of a container made from film portions 22, is represented by the arrows 20.

The female element 38 is of a conventional construction. The male closure element 36 consists of a single, arrow-shaped profile member 42 which extends from a base 44, and which has an extremity 46 which is suited for interlocking with the extremities 48 of profile members 50 comprising the female element 38.

The means employed by the embodiment of FIG. 3 for guiding the extremities 46 and 48 into interlocking engagement comprises raised portions 52 of the base 44 which flank the profile member 42 on both sides, and which are positioned generally adjacent the profile member 42. Each raised portion 52 is characterized by a crest 54 and a downwardly sloping side 56 extending from the crest 54 toward the profile member 42.

Ribs 58 are located generally at both ends 60 of the base 44 of the male element 36, in a "wide track" construction. Accordingly, the ribs 58 are of a sufficient size and proximity to the profile member 42 so as to move together with the profile member 42 as a unit when the extremities 46 and 48 are engaged or disengaged and feel like part of the closure itself to a consumer. The ribs 58, further, have a height which is less than that of the profile member 42 but which is sufficient to extend beyond an end of and on a side of an extremity 48, whereby at least a portion of the extremity 48 is located between the profile member 42 and a rib 58 when the extremities 46 and 48 are interlockingly engaged.

A raised portion 52 of the base 44 is thus in the closure 34 positioned on each side of the profile member 42 between the profile member 42 and a rib 58.

Each raised portion 52 should in this and subsequent embodiments be of a sufficient size and positioned a sufficient distance away from the profile member 42, and should further define a sufficient downward slope from the crest 54 along side 56 toward the profile member 42, so that when compressive forces of the magnitude applied in FIG. 1 are applied to the closure 34, the extremities 48 of the female profile members 50 are received by the sides 56 of the raised portions 52 and urged therealong toward the profile member 42 and toward an interlocking engagement with the extremities 46.

In this connection, it is preferred that each side 56 define generally an angle of at least about 5 degrees, and most preferably at least about 10 degrees, with respect to the plane of the film portion 22 to which the male closure element 36 is joined. For other closures, the slope or steepness of a side 56 which is minimally required for guiding the extremities of any selected set of male and female profile members together may differ based on several factors, such as the configuration, size and composition of the profile members, as well as the coefficient of friction between a profile member and an opposing film portion.

The closure 34 is made by extruding a male closure element assembly 62 consisting of the above-described generally planar base portion 44, profile member 42, and ribs 58, and applying the assembly 62 to a separately extruded film portion 22 while the assembly 62 and the film portion 22 collectively contain enough heat to fuse the assembly 62 and the film portion 22 together.

Any non-integral zipper process should work in this regard, although the process described in commonly-assigned U.S. Pat. No. 4,755,248 to Geiger et. al. is preferred, such patent being hereby incorporated herein by reference. It should be noted that the female closure element 38 can also be applied to the film portion 22 by the same or a different non-integral zipper process of making reclosable plastic containers, or can be integrally formed with the film portion 22.

The formation of a raised portion 52 from the assembly 62 is believed to be attributable to two primary mechanisms or processes. In one mechanism, when the assembly 62 is applied to the film portion 22 in the presence of heat sufficient to fuse the two together, the preponderance of mass in the assembly 62 is at the ends 60 of the base portion 44 in the form of the preferably generally triangularly-shaped ribs 58, and in the center of the base portion 44 with the profile member 42. The greater mass at these locations is thought to cause the assembly 62 to fall onto and become joined to the film portion 22 at these locations first, resulting in a raised portion 52 between these locations which can be made permanent in the closure 34 on cooling the assembly 62 and film portion 22.

By a second mechanism, the hot assembly 62 contacts the film portion 22 and melts the material of the film portion 22 in the area of contact. The film portion 22 in this area, which may contain some degree of stress due to film orientation and/or the presence of lengthy side-chains in the material of the film portion 22, is then free to respond to and relieve this stress by contracting underneath the assembly 62 before the assembly 62 and film portion 22 are eventually cooled. The raised portions 52 are developed as the assembly 62, which is fused to the film portion 22 in the areas of the ribs 58 and the profile member 42, is contracted along with the underlying film portion 22.

These mechanisms suggest that the manufacture and design of a closure 34 and more particularly of a closure bearing a raised portion 52 should be dependent on certain factors, for example the distance between the profile member 42 and a rib 58, the thickness of a base portion 44, the distribution of mass in the assembly 62, the thickness or degree of orientation of the film portion 22, the melt temperature of an assembly 62 (where, as is conventional, the heat to fuse the assembly 62 to a film portion 22 is primarily supplied by a freshly-extruded assembly 62), and the rate of cooling of film 22 bearing a closure 34.

The design and manufacture of a particular closure 34 according to these factors and with the guidance provided herein will depend on a number of other circumstances, such as the materials of construction and the intended use of the container, but will be well within the capabilities of one of ordinary skill in the art of making these containers.

Figure 4:
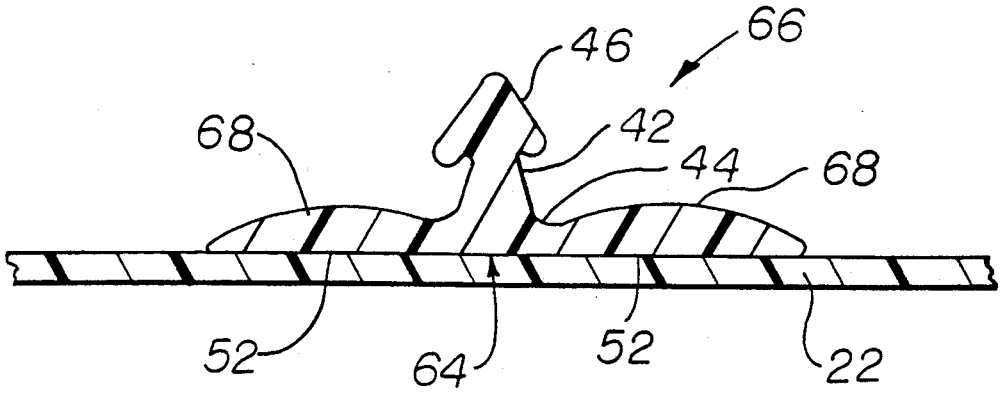
FIG. 4 is an enlarged cross-sectional view of the male closure element of an alternate embodiment of the closure of the present invention.

A second embodiment of the closure of the present invention is suggested in FIG. 4. In the embodiment of FIG. 4, a male closure element 64 is provided which consists again of a single, arrow-shaped profile member 42 extending from a base 44, and having an extremity 46 which is suited for interlocking with the extremities of a female element 38 such as shown in FIG. 3.

Means for guiding the extremities of the male and female elements into interlocking engagement are also provided in this embodiment as raised portions 52 of the base 44, and the embodiment may optionally further include ribs (not shown) at the ends 60 of the base 44 in a wide track construction.

The raised portions 52 are in general terms produced by extruding a male closure element assembly 66 which consists of a generally planar base portion 44, a profile member 42, and a protuberance 68 from the generally planar base portion 44 on each side of the profile member 42, and which may additionally consist of the ribs 58, and by thereafter joining the assembly 66 to a separately extruded film portion 22. This joinder of the assembly 66 can preferably be effected in the manner of the embodiment of FIG. 3, by applying the assembly 66 to the film portion 22 while the assembly 66 and film portion 22 are collectively sufficiently hot to fuse one to the other. Alternatively, however, the assembly 66 can be joined to the film portion 22 through the use of an adhesive.

Depending on the shape and size of the protuberances 68, and on the other factors enumerated earlier with respect to the height and slope of the raised portions 52 of the embodiment shown in FIG. 3, the raised portions 52 with crests 54 and downwardly sloping sides 56 can be created for the embodiment of FIG. 4 by the same process as described above for the embodiment of FIG. 3, using the greater mass of the ribs 58 and the profile member 42 to augment the downward slope of the protuberances 68 created initially in the extrusion of the assembly 66.

Or, the raised portions 52 can be extruded originally of the proper size, shape and proximity to the profile member 42, and then simply joined to the film portion 22 as described above. The raised portions 52 may also manufactured by a combination of these methods, as will be readily appreciated.

Figure 5:
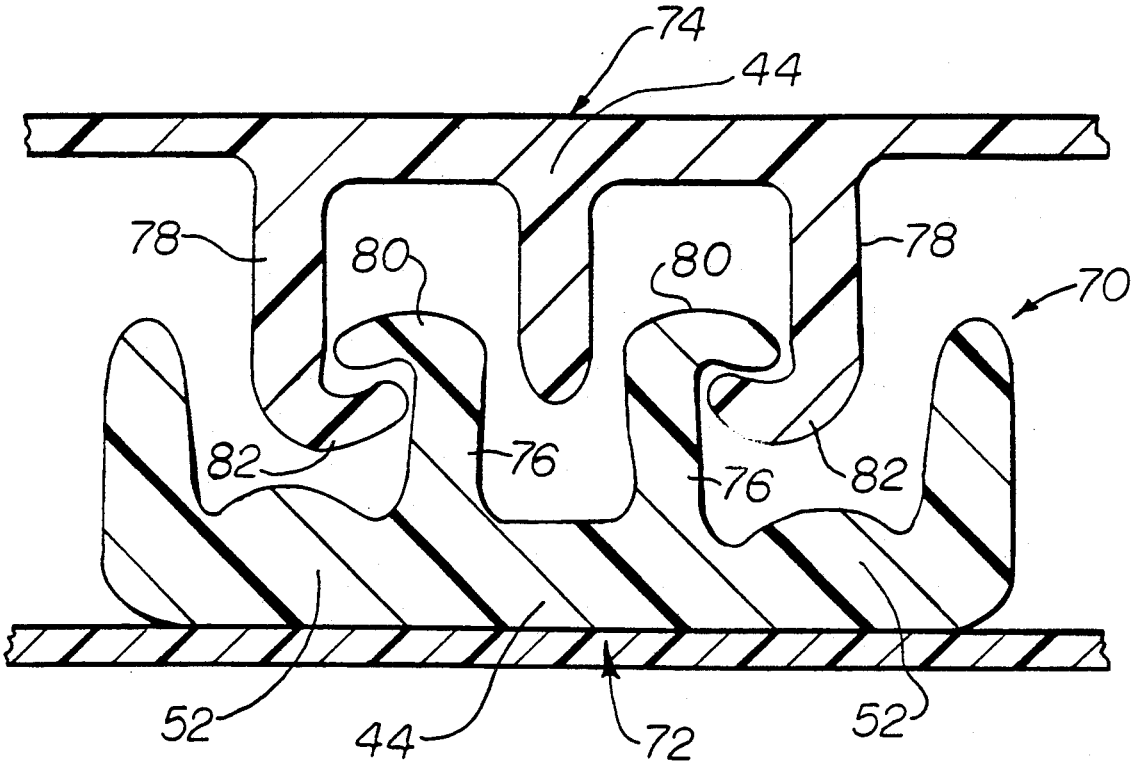
FIG. 5 is an enlarged cross-sectional view of still another embodiment of the present invention.

The closure of the present invention can take a number of other forms as well, as illustrated in FIG. 5. The closure 70 depicted in FIG. 5 comprises oppositely disposed male and female closure elements 72 and 74 which are of a different configuration than those of the embodiments shown in FIGS. 3 and 4, and which are each comprised of a plurality of profile members 76 and 78, respectively, extending from a common base 44 and having interlocking extremities 80 and 82. Means are again provided in the embodiment of FIG. 5 for guiding the extremities 80 and 82, respectively, of the elements 72 and 74 into interlocking engagement in response to deforming compressive force.

The means employed for guiding the extremities 80 and 82 into interlocking engagement can comprise a raised portion 52 of the base 44 which is produced in the manner of the embodiment shown in FIG. 3, through the use of a male closure element assembly with ribs. Or, the raised portion 52 can also be formed through the use of a male closure element assembly with protuberances, in the manner of the embodiment shown in FIG. 4.

While preferred embodiments have been described herein, it is evident that still other embodiments of a closure for reclosable plastic containers comprising oppositely disposed closure elements having interlocking extremities, and means for guiding these extremities into interlocking engagement responsive to the sort of deforming compressive force evidenced in FIG. 1, can be constructed which are within the scope and spirit of the present invention and which are intended therefore to be encompassed within the following claims.

What is claimed is:

1. A closure for reclosable plastic containers which comprises:

oppositely disposed male and female closure elements having interlocking extremities; and raised portion guiding means for guiding each of the extremities of a closure element which are suited for interlocking engagement with an extremity of an oppositely disposed closure element toward such an interlocking engagement when deforming compressive force is applied to the elements.

2. A closure as defined in claim 1, wherein the male closure element comprises one or more profile members extending from a common base and having an extremity suited for interlocking with an extremity of the female element.

3. A closure as defined in claim 2, wherein the guiding means comprises a raised portion of the base positioned generally adjacent a profile member, and sloping downwardly from a crest of the raised portion along a side thereof toward the profile member.

4. A closure as defined in claim 3, wherein the crest of the raised portion is positioned a sufficient distance away from the profile member, and the raised portion is of a sufficient size and defines a sufficient downward slope from the crest toward the profile member so that an extremity of an oppositely disposed female element is received by the raised portion and urged along the downwardly sloping side thereof toward the profile member when deforming compressive force is applied to the male and female closure elements.

5. A closure as defined in claim 4, wherein the downwardly sloping side portion defines generally an angle of at least about 5 degrees with respect to the plane of the base.

6. A closure as defined in claim 5, wherein an angle of at least about 10 degrees is defined generally between the downwardly sloping side portion and the plane of the base.

7. A closure as defined in claim 4, further comprising a rib of a sufficient size and proximity to the profile member of the male closure element so as to move together with the profile member as a unit when the extremities of the male and female closure elements are engaged or disengaged and feel like part of the closure itself, the rib having a height less than that of the profile member yet being tall enough to extend beyond an end of and on a side of the extremity of the female closure member whereby at least a portion of the extremity of the female closure element is located between the profile member and the rib when the extremities of the male and female closure elements are engaged.

8. A closure as defined in claim 7, wherein the raised portion is positioned between the rib and the profile member.

9. A closure as defined in claim 7, wherein:

the male closure element consists of a single profile member and a rib and a raised portion are defined on both sides of the profile member, with the raised portion on each side of the profile member being positioned between the profile member and a rib.

10. A reclosable plastic container including a closure as defined in claims 1, 2, 4 or 9.

* * * * *